US005565241A

United States Patent [19]

Mathias et al.

[11] Patent Number: 5,565,241

[45] **Date of Patent: *Oct. 15, 1996**

[54] CONVERGENT END-EFFECTOR

[75] Inventors: David D. Mathias, Athens; Jack G. Scarpa; Terry L. Hall, both of Huntsville, all of Ala.

[73] Assignee: USBI Co., Huntsville, Ala.

[ * ] Notice: The term of this patent shall not extend beyond the expiration date of Pat. No. 5,307,992.

[21] Appl. No.: 288,372

[22] Filed: Aug. 10, 1994

[51] Int. Cl.[6] ..... B05D 1/34

[52] U.S. Cl. ..... 427/196; 427/426; 118/308; 239/296; 239/300; 239/416.5; 239/418; 239/553.5; 239/424; 239/425.5; 239/430; 239/549

[58] Field of Search ..... 427/196, 426; 118/308; 239/430, 549, 553.5, 416.5, 424, 425.5, 418, 296, 300

[56] References Cited

U.S. PATENT DOCUMENTS

| | | | |
|---|---|---|---|
| 1,219,642 | 3/1917 | Isaacs . | |
| 2,260,461 | 10/1941 | Kolts | 94/1.5 |
| 2,433,463 | 10/1944 | Lampe | 427/196 |
| 2,971,700 | 2/1961 | Peeps | 239/296 |
| 3,107,057 | 10/1963 | Hanusch | 239/336 |
| 3,185,396 | 5/1965 | Black | 239/336 |
| 3,214,103 | 10/1965 | Kempthorne | 239/422 |
| 3,504,861 | 4/1970 | Peeps | 239/300 |
| 3,720,377 | 3/1973 | Hart et al. | 239/336 |
| 3,907,170 | 9/1975 | Schedrin et al. | 222/135 |
| 4,809,909 | 3/1989 | Kukesh | 239/1 |
| 4,934,595 | 6/1990 | Reimer | 239/8 |
| 5,190,217 | 3/1993 | Black et al. | 239/154 |
| 5,307,992 | 5/1994 | Hall et al. | 239/135 |

FOREIGN PATENT DOCUMENTS

| | | |
|---|---|---|
| 1556352 | 2/1969 | France . |
| 2032618 | 11/1970 | France . |
| 1334733 | 10/1973 | United Kingdom . |

*Primary Examiner*—Shrive Beck
*Assistant Examiner*—David M. Maiorana
*Attorney, Agent, or Firm*—Pamela J. Curbelo

[57] ABSTRACT

A convergent end-effector which combines a liquid and dry flow external to a spray nozzle eliminates clogging problems common in the prior art spray coating systems. The end-effector utilizes a nozzle with an orifice and at least one atomizing hole, a conduit for directing a liquid resin through the nozzle and an outer housing disposed around said conduit to form a cavity. Reinforcing material enters the cavity on an gas stream supplied and controlled by an eductor located prior to the outer housing, in the direction of the nozzle, and at an angle of less than about 90° with respect to the conduit. The end of the conduit near the nozzle is preferably angled toward the nozzle to further direct the reinforcing material into the liquid resin.

7 Claims, 1 Drawing Sheet

CONVERGENT END-EFFECTOR

TECHNICAL FIELD

The present invention relates to coating a substrate with a two-phase mixture, and especially relates to a convergent end-effector for coating a substrate with a liquid resin containing a reinforcing material.

BACKGROUND OF THE INVENTION

Coating substrates with reinforced resin matrices, such as liquid resins reinforced with fibers, glass microspheres, or other reinforcing or filler materials (hereinafter referred to as reinforcing material), conventionally requires mixing the liquid resin with the reinforcing material and then painting or spraying the mixture onto the substrate, or dipping the substrate into the mixture. When only a portion of the substrate requires coating, accuracy and control requirements typically dictate the use of a spray coating process. Spray coating processes, however, are limited due to the low sprayability of high performance liquid resins which are typically highly viscous, the limit in attainable coating thickness, and the high amount of waste material generated.

Many liquid resins utilized in spray coating processes possess viscosities of about 20,000 centipoise (cps) or greater. At such high viscosities, pumping the liquid resin through the lines and nozzle of a spray coating apparatus is difficult and requires large amounts of energy. In order to reduce energy requirements and to simplify the spray coating process, the viscosity of the liquid resin is often reduced to about 2,000 cps by mixing the liquid resin with a solvent. Typically, however, solvents useful in spray coating processes are generally environmentally hazardous. Consequently, waste material from the spray coating process must be disposed of as hazardous waste.

Conventional spray coating processes comprise combining a liquid resin, flow leveling and spray solvents, reinforcing material, and other conventional constituents such as curing agents, biocides, catalysts, etc., in a tank to form a mixture. This mixture is then pumped from the tank through lines to a nozzle where it is atomized and sprayed onto the substrate. Once the mixture has been applied to the substrate, the flow leveling solvents are removed therefrom by the natural evolution of volatile gas and/or by applying heat to the mixture to hasten the solvent evolution.

During the flow leveling solvent evolution, solvent near the substrate surface migrates to the coating surface, dragging liquid resin with it, and thereby forming resin starved areas in the coating. These resin starved areas result in poor adhesion between the coating and the substrate, and act as potential coating failure points. The effect of the solvent migration can be minimized by applying thinner coatings, less than about 0.04 inches (0.10 cm), to the substrate. However, thick coatings of about 0.25 inches (0.64 cm) to about 0.50 inch (1.27 cm) or greater, are often required to attain the desired substrate protection, such as thermal protection.

An additional disadvantage of these coating processes relates to pot life. Since all of the coating constituents are combined in a tank and pumped through the coating system as a single mixture, there is limited time available to process and apply the coating. During the pumping, the liquid resin can begin to set up within the system and the reinforcement can accumulate within the lines or the nozzle, both resulting in a clogged nozzle and/or lines. Additionally, any unused portion of the batch must be disposed of as hazardous waste due to the presence of the hazardous solvents.

U.S. Pat. No. 5,307,992, to Hall et al. discloses an improved coating system and process where the liquid resin and reinforcing material are mixed external to the nozzle, thereby virtually eliminating clogging problems and significantly reducing system waste. The end effector used therein, however requires a separate gas line and utilizes an air disc to carry the reinforcing material to the liquid resin. These components render the end-effector large, difficult to maneuver, and impractical to use in confined spaces.

What is needed in the art is an improved end-effector for a convergent spray coating apparatus and process.

DISCLOSURE OF THE INVENTION

The present invention relates to a spray coating apparatus, comprising: an end-effector, a liquid resin supply, a reinforcing material supply, and at least one eductor for moving the reinforcing material. The end-effector comprises a spray nozzle for directing liquid resin toward the substrate having an orifice and at least one atomizing hole circumferentially disposed around said orifice; a conduit for introducing the liquid resin to said nozzle, said conduit having an outer surface, a first end, a second end, and an axis which intersects said first end and said second end, wherein said nozzle is connected to said first end; an outer housing located coaxial with and circumferentially disposed around said conduit so as to form a cavity therebetween, said outer housing having an open end located near said first end of said conduit; and at least one reinforcing material inlet for introducing reinforcing material to said cavity, wherein said inlet introduces the reinforcing material at an angle less than about 90° with relation to the conduit's axis.

The foregoing and other features and advantages of the present invention will become more apparent from the following description and accompanying drawings.

These figures are meant to further clarify and illustrate the present invention and are not intended to limit the scope thereof.

BEST MODE FOR CARRYING OUT THE INVENTION

The present invention is directed toward an improved end-effector which has a high transfer efficiency (substantially all of the reinforcing material is wetted and deposited on the surface of the substrate) and produces a smooth surface finish.

With the end-effector of the present invention, the liquid resin and reinforcing material are mixed at a point external to the spray coating apparatus. Both the liquid resin and the reinforcing material are directed toward the substrate, with the reinforcing material circumferentially disposed around the liquid resin flow. After exiting the nozzle in the spray coating apparatus, the combination of the low pressure created by the atomization of the liquid resin and the mechanical shaping of the reinforcing material flow by the outer housing, conduit, and reinforcing material inlets causes the reinforcing material to converge with the liquid resin, thereby wetting the reinforcing material with liquid resin prior to deposition on the substrate. This apparatus configuration and method eliminates clogging problems commonly caused by the reinforcing material.

Figure 2:
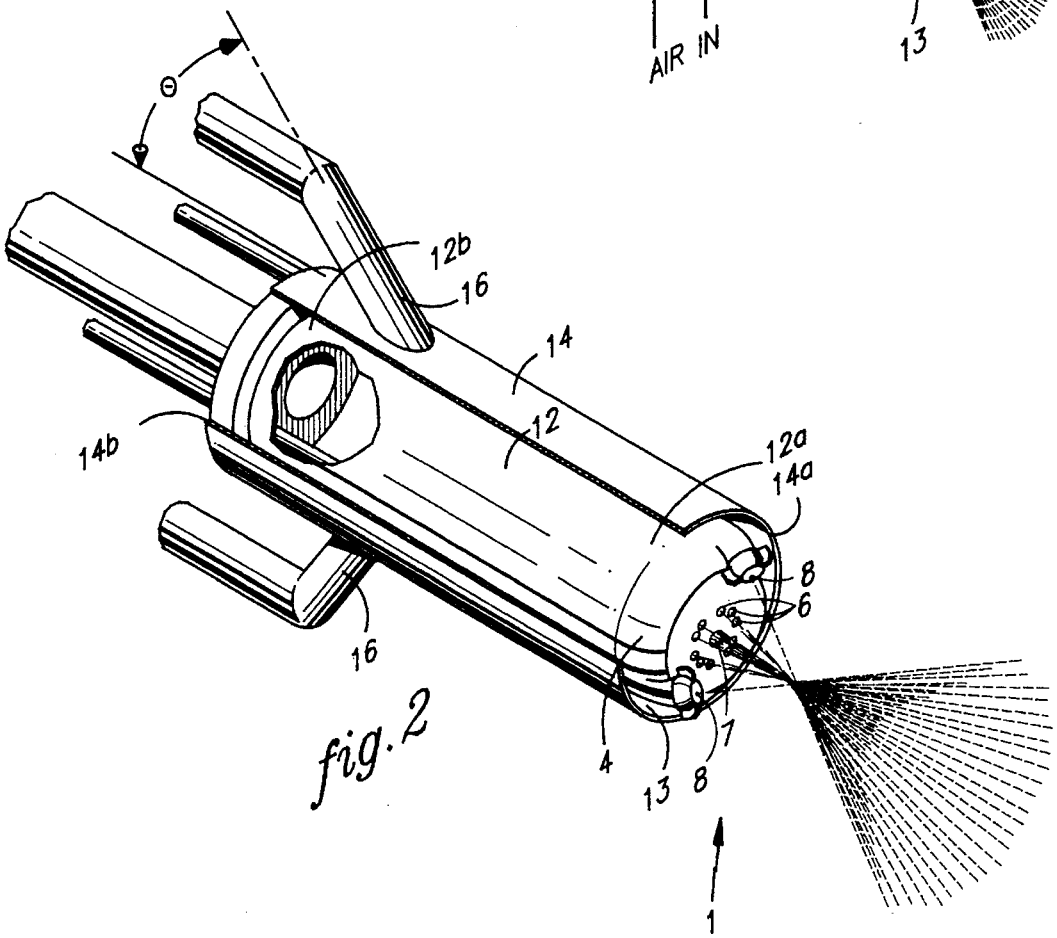
FIG. 2 is a cut-away view of one embodiment of the spray coating apparatus of the present invention.

The convergent spray apparatus comprises an outer housing 14 circumferentially disposed around and coaxial with a conduit 12 such that a cavity 13 is formed therebetween, with a nozzle 1 having a liquid orifice 7, atomizing holes 6, and shaping holes 8, connected to one end of the conduit 12 (see FIG. 2). The conduit 12 which functions as a device for introducing the liquid resin to the nozzle 1, can be any conventional means capable of directing the liquid resin to the nozzle 1 having a first end 12*a* and a second end 12*b*, with the first end 12*a* connected to the nozzle 1, such as a conduit, a channel, a pipe, a cylinder, or another conventional means. Similarly, the nozzle can be conventional, such as spray nozzles produced by Binks, Franklin Park, Ill., and Graco, Minneapolis, Minn., among others, having an orifice 7 for moving the liquid resin out of the conduit 12, at least one atomizing hole 6 for atomizing the liquid resin once it passes out of the orifice 7, and optionally, shaping holes 8 for controlling the spray area of the liquid resin by forming it into a controlled spray having the desired width and height.

The orifice 7 which is typically located substantially in the center of the nozzle 1, directs the liquid resin from the nozzle 1 toward the substrate. This orifice 7 can be a single hole or a plurality of holes having any geometry and a size which supports the desired liquid resin flow rate. Typically, this orifice 7 is about 0.005 inches (0.0127 cm) to about 0.5 inches (1.27 cm) in diameter, with about 0.01 inches (0.0254 cm) to about 0.1 inches (0.254 cm) preferred for most liquid resins having viscosities of about 1,000 cps to about 5,000 cps.

At least one atomizing hole 6 is circumferentially disposed around the orifice 7. The parameters of the atomizing holes 6, which are readily determined by an artisan, are system dependent based upon the type of liquid resin to be atomized, the pressure required for such atomization, and the desired droplet size of the atomized liquid resin. The smallest, feasibly attainable droplet sizes are preferred to ensure high wetting of the reinforcing material when it converges with the liquid resin (discussed below). High wetting of the reinforcing material produces a stable coating having structural integrity and improved texture and surface finish. Decreasing the droplet sizes comprises increasing the gas pressure prior to the atomizing holes 6 or decreasing the diameter of the atomizing holes 6. For instance, in an epoxy coating system utilizing cork reinforcing material, the preferred atomizing hole diameter is about 0.005 inches (0.0127 cm) to about 0.001 inches (0.00254 cm) using a gas pressure of about 15 psig (1.03 bar) to about 45 psig (3.10 bar), with the liquid resin passing through the orifice 7 having a diameter of about 0.030 inches (0.076 cm) to about 0.090 inches (0.229 cm) at a pressure of about 50 psig (3.45 bar) to about 125 psig (8.62 bar).

As with the atomizing hole(s) 6, shaping holes 8 are also circumferentially disposed around the orifice 7, but typically at a greater distance from the orifice 7 than the atomizing holes 6 since atomizing the liquid resin after the liquid resin flow has been shaped may reduce control over the liquid resin flow shape causing liquid resin to be applied to the substrate in undesired areas. The shaping holes 8 are optionally employed to control the spray area of the liquid resin flow, typically by forming the flow into a fan shape having an essentially elliptical circumference so that it can be sprayed onto a designated area of the substrate. Depending upon the desired fan width, the type of liquid resin, the size and amount of shaping holes, the angle between the liquid resin flow axis and the shaping holes, and the geometry of the area of the substrate to be coated, the pressure of the gas entering the shaping holes is adjusted. Increasing the gas pressure to the shaping holes 8 decreases the fan width while decreasing the gas pressure to the shaping holes 8 increases the fan width. Continuous atomization of the liquid resin while adjusting the gas pressure to the shaping holes 8 over a broad range of pressures requires maintenance of separate pressure controls for the atomizing holes 6 and the shaping holes 8. Therefore, separate pressure controls and gas supply lines are preferred for the atomizing holes 6 and the shaping holes 8.

Typically, the angle between the shaping holes 8 and the liquid resin flow axis is about 5° to about 85°, with about 20° to about 45° preferred. The pressure of the gas entering two shaping holes S having an angle of about 20° to about 45° and a diameter of about 0.01 (0.0254 cm) inches to about 0.2 inches (0.508 cm), ranges from about 10 psig (0.69 bar) to about 70 psig (4.83 bar). A pressure of about 15 psig (1.03 bar) to about 30 psig (2.07 bar) is preferred for holes having a diameter of about 0.03 inches (0.076 cm) to about 0.15 inches (0.381 cm). Different pressures may be preferred for different amounts of shaping holes or for shaping holes having angles greater than about 45° or less than about 20°.

Concurrent with the flowing of the liquid resin through the conduit 12, the flow of the liquid resin through the orifice 7, the atomization of the liquid resin, and the shaping thereof, the reinforcing material is carried in a gas stream through the cavity 13 and past the nozzle 1 where it converges with and is drawn into the liquid resin flow to form a substantially homogenous combined flow. The cavity 13 is formed by an outer housing 14 located coaxial with and circumferentially disposed around the conduit 12 with an open end 14*a* located near the first end 12*a* of the conduit 12. This cavity 13 functions as a means for confining, shaping, and directing the reinforcing material flow while a gas from the eductor(s) 28 located prior to the cavity 13 suspends the reinforcing material and carries it through the cavity 13. The size of the cavity 13 is preferably only sufficiently large to maintain a vacuum on the eductors (discussed below), thereby orienting the reinforcing material as close to the conduit 12 as practical and therefore close to the liquid resin flow exiting the nozzle 1. Generally, in order to maintain the vacuum, the cross-sectional area of the cavity 13 should be at least as large as the cross-sectional area of the outlet of the largest eductor 28. For a glass/cork system, for example, the cross-sectional area of the eductor outlets are preferably about 0.45 inches (1.14 cm) and about 0.8 inches (2.03 cm). Consequently, the cross-sectional area of the cavity 13 is about 1.25 inches (3.18 cm).

The eductors 28 are any conventional device capable of moving the reinforcing material from the supply 20 through the inlet 16 and out cavity 13 for entry into the liquid resin flow, such as eductors produced by Fox Venturi, Fairfield, N.J. Typically, the eductors 28 utilize a gas stream and a vacuum to move the reinforcing material through the spray apparatus.

Introduction of the reinforcing material to the liquid resin is important since non-uniform introduction inhibits complete mixing of the reinforcing material with the liquid resin. Non-uniform mixing decreases the wetting of the reinforcing material and the structural integrity of the coating, thereby providing possible points of strength reduction. Uniform distribution of the reinforcing material around the conduit 12 which provides a more homogenous entry of the reinforcing material into the liquid resin is accomplished via multiple reinforcing material inlets, conduits 16, preferably 2 or more, distributed around the cavity 13, by the small volume of cavity 13, and by the gas flow produced by the eductors 28.

The conduits 16 which introduce the reinforcing material to the cavity 13 are typically oriented at an angle θ which assists in the uniform distribution of the reinforcing material around the conduit 12. Typically, the inlet 16's orientation with respect to the conduit 12 axis is at an angle θ from about parallel with the axis of the conduit 12 up to about 75°, with about 60° to about 70° preferred, and about 62° to about 67° especially preferred.

Conventional means can be employed to introduce the reinforcing material to the inlet 16. Possible means include gravity feeders, cork screw feeders, belt feeders, pressurized feeders, vibratory feeders, and other conventional feeders. One such feeder, a "loss-in-weight" vibratory feeder produced by Schenk, Fairfield, N.J., is preferred for use in a stationary convergent spray system since it is capable of continuously introducing a given amount of reinforcing material to the inlet 16, thereby allowing the introduction of a substantially homogenous amount of reinforcing material to the liquid resin and improving the wetting of the reinforcing material.

In order to further assist in the introduction of the reinforcing material to the liquid resin and ensure wetting of substantially all of the reinforcing material, the conduit and/or nozzle shape can be adjusted. Angling the outer surface of the conduit 12 such that the diameter of the conduit 12 is smaller at the first end 12*a* than the second end 12*b*, thereby directing the reinforcing material into the liquid resin stream. The angling can be accomplished by angling the entire conduit 12, angling only a portion thereof using an inner housing adjacent to the conduit 12, or via other conventional means. (see 4, FIG. 2) With respect to the flow rate, if the flow rate is too great, a larger amount of reinforcing material will be drawn into the liquid resin than the resin is capable of wetting, thereby producing a coating with resin starved areas while if the flow rate of the reinforcing material is too slow, an insufficient amount of reinforcing material will be available to reinforce the coating. The preferred flow rate of both the reinforcing material and the liquid resin can readily be determined by an artisan based upon the specific reinforcing material and liquid resin. Typically, the reinforcing material is supplied at a rate of about 50 g/min (grams per minute) to 200 g/min for an epoxy liquid resin/cork coating system. However, this rate can be varied according to the systems and the amount of reinforcing material desired in the coating and cost considerations.

Wetting of the reinforcing material can also be improved by enhancing the flowability and the atomization of the liquid resin. As the viscosity of the liquid resin decreases, the mobility of the liquid resin through the coating system improves and the ability to atomize the liquid resin to smaller droplet sizes also improves. Typically, the liquid resin has a high viscosity, about 20,000 cps or greater, while viscosities of about 2,000 cps are preferred, with viscosities of about 900 cps to about 1,500 cps especially preferred for 2216 A & B liquid resin systems (two component resin systems) produced by 3M Corp., St. Paul, Minn.

Figure 1:
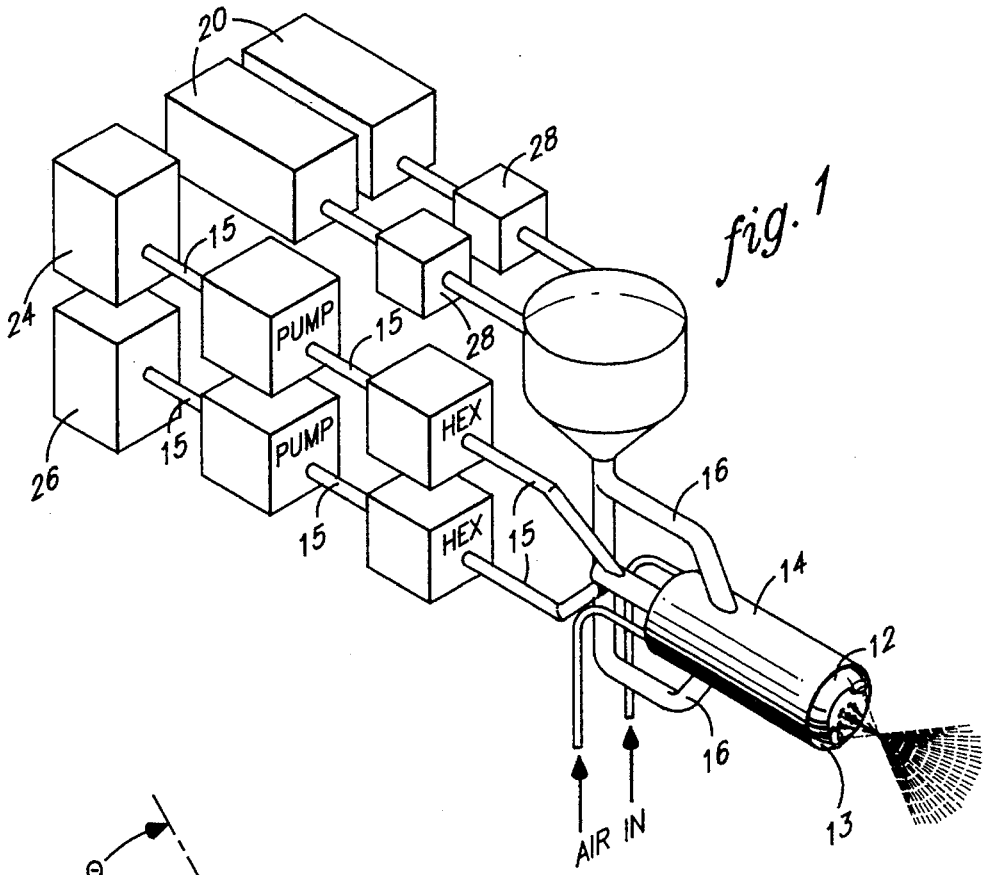
FIG. 1 is one embodiment of the spray coating system of the present invention.

The liquid resin's viscosity can be adjusted by heating the liquid resin either in the liquid resin supply 24 and 26 (see FIG. 1), in the lines 15 which directs the liquid resin to the conduit 12 or in the conduit 12 itself. Sufficient heat is applied to the liquid resin to lower the liquid resin's viscosity to about 2,000 cps or lower without prematurely curing or deteriorating the liquid resin, with a viscosity of about 1,000 cps or lower preferred. The appropriate temperature to heat the liquid resin is readily determined by an artisan and is dependent upon the characteristics of the liquid resin itself. For a 2216 A & B liquid resin system, an epoxy resin and accelerator, it is preferred to heat the epoxy resin and accelerator to about 110° F. (43.3° C.) to about 200° F. (99.3° C.) in order to decrease its viscosity from about 20,000 cps to about 1,000 cps, thereby obtaining flow rates which promote atomization of the liquid resin. Temperatures higher than this tend to cure the epoxy resin prematurely and clog the spray coating apparatus while lower temperatures fail to sufficiently lower the epoxy resin viscosity.

Once the reinforcing material has converged with the liquid resin, the combined flow then contacts the substrate. The distance between the nozzle 1 and the substrate, commonly known as the stand-off distance, is determined by the trajectory of the combined flow. It is preferred that the stand-off distance correspond to that distance which is less than the distance at which the trajectory of the combined flow would arc downward due to the pull of gravity. Typically, the stand-off distance can be up to about 30 inches (76.2 cm) or greater, with about 8 inches (20.32 cm) to about 15 inches (38.1 cm) preferred for most cork/glass/epoxy liquid resin coatings.

Where a plurality of liquid resins are desired or if any conventional constituents such as curing agents, catalysts, biocides, etc., are employed, a mixing means can be utilized. This mixing means resides in the conduit 12 prior to the nozzle 1 such that the liquid resins and other constituents are mixed immediately prior to entering the nozzle 1 to form a resinous mixture. Locating this mixer adjacent to the nozzle 1 eliminates the requirement for long lines between the mixer and the nozzle 1, thereby reducing the length of time between the mixing of the liquid resin and the spraying of the resinous mixture onto the substrate, and reducing the possibility of line or equipment clogging, reducing the amount of excess resinous mixture, waste material, in the lines once the coating process is complete. Possible mixing means include conventional mixers such as static mixers, dynamic mixers, and other conventional means. Dynamic mixers are preferred since they require minimal length.

During operation of the spray coating apparatus, the liquid resin passes through the conduit 12 and out of the orifice 7 in nozzle 1 while the reinforcing material is simultaneously carried in a gas stream through cavity 13 and past the nozzle 1. Once the liquid resin flows out of the orifice 7, it is atomized by gas passing through atomizing holes 6. If shaping holes 8 are employed, gas passing through the shaping holes 8 molds the liquid resin flow. Otherwise, the flow shape is substantially conical due to the atomizing holes 6. Meanwhile the reinforcing material flows past the nozzle and is both drawn into the liquid resin by a low pressure created by the liquid resin exiting the nozzle, and converges with the liquid resin stream due to the direction which the reinforcing material flows from the cavity 13. The combined flow then contacts the substrate.

Consequently, coating a substrate with a four-part coating having two reinforcing materials and a two component liquid resin with high viscosity will trace the following sequence. Two liquid resin components, A and B, are heated to reduce their viscosity to about 1,000 cps and are separately transported from the liquid resin supplies 24 and 26, respectively, to the conduit 12 through the second end 12*b* where they are mixed in a conventional fashion to form a resinous mixture. This resinous mixture is introduced to the nozzle 1 where it passes through the orifice 7 and is atomized into fine droplets by gas passing through ten atomizing holes 6, about 75 microns to about 100 microns in diameter.

Meanwhile, the two reinforcing materials pass through a mixer, through eductors 28 and then are carried through inlet 16 and cavity 13 toward the substrate. Once the reinforcing materials pass the nozzle 1, they converge with and are drawn into the resinous mixture and are wetted, thereby forming a combined flow. This combined flow is propelled against the substrate to form the coating.

The thickness of this coating can be varied by altering the rate of motion between the nozzle 1 and the substrate. As the relative motion decreases, the coating thickness increases. Additionally, the formulation (reinforcing material to resin ratio), droplet size, and/or the flow rate of the liquid resin can be adjusted to attain the desired coating density and/or strength. Increasing the reinforcing material flow rate decreases the coating density while decreasing the reinforcing material flow increases the coating strength.

It should be noted that the present spray coating apparatus and method can be automated utilizing conventional automation techniques and equipment such as programmable logic controllers, computers, metering devices, pressure control devices, and other conventional equipment.

The present invention will be clarified with reference to the following illustrative example. This example is given to illustrate the process of coating a substrate using the spray coating apparatus of the present invention. It is not, however, meant to limit the generally broad scope of the present invention.

EXAMPLE

The following process has been used to produce a 0.50 thick coating of 2216 epoxy liquid resin, cork, and glass microspheres on a painted substrate.

1. A 5 gallon (18.925 liters) supply of 2216 liquid resin (Part B) and a 5 gallon (18.925 liters) supply of curing agent (Part A, amine terminated polymer) were separately heated to 140° F. (60° C.) and pumped at a rate of 225 grams per minute (g/min) (200 milliliters per minute (ml/min)) to the conduit 12 where they were mixed to form a resinous mixture.
2. The resinous mixture then passed through the orifice 7 in the nozzle 1 and was atomized by 10 atomizing holes 6 having diameters of 0.015 to 0.020 inches (0.0381 to 0.0508 cm) and expending air at 25 psig (1.72 bar).
3. The atomized resinous mixture was then shaped by 4 shaping holes 8 expending air at a pressure of 15 psig (1.03 bar), thereby producing an 8 inch (20.32 cm) fan pattern. These shaping holes 8 were located at an angle of 20° with the resinous mixture flow axis.
4. Concurrent with the liquid resin flow, 100 g/min (700 ml/min) of cork and 100 g/min (200 ml/min) of glass microspheres, under 20 psig (1.38 bar), were introduced to the cavity 13 through a stainless 3 $ft^3$ stall with a screw type metering system and through inlet 16.
5. The cork and glass were then suspended and carried toward the substrate, around the conduit 12, by the same air that transported it from the loss-in-weight feeder.
6. Upon reaching the end of the conduit 2, the cork and glass were drawn into the resinous mixture and wetted, thereby forming a combined flow.
7. With the nozzle 1 maintained at a 10 inch (25.4 cm) stand-off distance from the substrate, the combined flow produced a 0.5 inch (1.27 cm) coating on a vertical substrate after 4 passes.

The coating of the above Example was a uniform, lightweight cork/glass coating with a density range from about 20 $lbs/ft^3$ (pounds per cubic foot) (0.32 grams per cubic centimeter ($g/cm^3$)) to about 30 $lbs/ft^3$ (0.48 $g/cm^3$), and having a flatwise tensile adhesion range from about 100 psi (6.89 bar) to about 350 psi (24.13 bar). This coating can be used as a thermal insulation or as an ablative coating for aerospace hardware.

The advantages of the present invention include decreased waste, lower cost, simplified maintenance and system, improved and more uniform liquid wetting of the reinforcing material and sturctural integrity at lower densities, improved sprayability and maneuverability, elimination of pot life issues, and the ability to produce uniform thick coatings with excellent adhesion. On horizontal surfaces, unlimited coating thicknesses can be obtained. On vertical surfaces, coatings up to 1 inch (2.54 cm) or greater can be obtained with the initial process, while coatings up to about 4 inches (10.16 cm) or greater can be obtained if the coating is dried after approximately each inch has been applied.

Since the liquid resin is not combined with the reinforcing material within the spray coating apparatus and since the liquid resin is not mixed with additional liquid resins or other conventional components until immediately prior to the nozzle, the amount of liquid resin and/or combined reinforcing material and liquid resin which must be discarded as waste is minimal, and clogging problems are virtually eliminated.

Generally, prior art spray coating processes comprised preparing the coating mixture by mixing the liquid resin with a solvent in a tank or pot to decrease its viscosity, then pumping the mixture through lines to a spray nozzle, and spraying the mixture onto the substrate. Since the entire mixing process occurred early in the process, the entire system required cleaning because the excess mixture in the lines can begin to cure, thereby clogging the system. Additionally, a greater amount of excess mixture was produced, and since the solvent was typically an environmentally hazardous substance, the entire excess mixture was hazardous, thereby increasing disposal costs and harming the environment.

The present end-effector is an overall improvement over prior art end-effectors since it produces smooth coated surfaces and has a high transfer efficiency.

Although this invention has been shown and described with respect to detailed embodiments thereof, it would be understood by those skilled in the art that various changes in form and detail thereof may be made without departing from the spirit and scope of the claimed invention.

We claim:

1. A spray coating apparatus, comprising:

a. an end-effector having i. a spray nozzle for directing liquid resin toward the substrate, said nozzle having an orifice and at least one atomizing hole circumferentially disposed around said orifice, ii. a conduit for introducing the liquid resin to said nozzle, said conduit having an outer surface, a first end, a second end, and an axis which intersects said first end and said second end, wherein said nozzle is connected to said first end, iii. an outer housing located coaxial with and circumferentially disposed around said conduit so as to form a cavity therebetween, said outer housing having an open end located near said first end of said conduit, and iv. at least one reinforcing material inlet for introducing reinforcing material to said cavity; and e. a liquid resin supply connected to said conduit;

f. a reinforcing material supply connected to said outer housing;

g. at least one eductor for moving the reinforcing material from the reinforcing material supply, through said inlet and said conduit, and past said nozzle.

2. A spray coating apparatus as in claim 1, further comprising a plurality of shaping holes circumferentially disposed around said orifice.

3. A spray coating apparatus as in claim 2 further comprising a plurality of gas supply lines, wherein separate gas supply lines are connected to said atomizing holes and said shaping holes.

4. A spray coating apparatus as in claim 1 further comprising a liquid resin supply connected to said means for introducing said liquid resin, having a heater for reducing the viscosity of said liquid resin.

5. A spray coating apparatus as in claim 1 wherein said outer surface of said conduit is angled so as to direct the reinforcing material into the liquid resin after it exits the nozzle.

6. A spray coating apparatus as in claim 1 wherein said inlet is angled at less than about 90° with relation to the conduit's axis.

7. A method for coating a substrate, comprising the steps of:

a. introducing a liquid resin to a conduit connected to a nozzle having an orifice and at least one atomizing hole circumferentially disposed around said orifice;

b. creating an area of low pressure by passing said liquid resin through said orifice and atomizing said liquid resin with gas passing through the at least one atomizing hole;

c. introducing reinforcing material to a cavity at an angle of less than 90° with respect to said conduit;

d. carrying the reinforcing material past the nozzle such that the area of low pressure causes said reinforcing material to be drawn into, converged with and wetted by the atomized liquid resin prior to contacting the substrate; and e. contacting the mixture of resin and reinforcing material with the substrate.

* * * * *

UNITED STATES PATENT AND TRADEMARK OFFICE

CERTIFICATE OF CORRECTION

PATENT NO. : 5,565,241

DATED : October 15, 1996

INVENTOR(S) : David D. Mathias et al

It is certified that error appears in the above-indentified patent and that said Letters Patent is hereby corrected as shown below:

In column 4 at line 17, change "S" to —8—.
In column 7 at line 61, change "2" to —12—.

Signed and Sealed this

Fifth Day of August, 1997

Bruce Lehman

*Attest:*

BRUCE LEHMAN

*Attesting Officer*

*Commissioner of Patents and Trademarks*